US008002135B2

(12) United States Patent
Tanaka

(10) Patent No.: US 8,002,135 B2
(45) Date of Patent: Aug. 23, 2011

(54) CONTAINER FOR ADHESIVE AGENT, MANUFACTURE METHOD THEREOF

(75) Inventor: Akinori Tanaka, Osaka (JP)

(73) Assignee: Alteco Inc., Osaka (JP)

( * ) Notice: Subject to any disclaimer, the term of this patent is extended or adjusted under 35 U.S.C. 154(b) by 320 days.

(21) Appl. No.: 11/808,647

(22) Filed: Jun. 12, 2007

(65) Prior Publication Data

US 2007/0284275 A1 Dec. 13, 2007

(30) Foreign Application Priority Data

Jun. 12, 2006 (JP) ..... 2006-162168

(51) Int. Cl.
*A61B 17/06* (2006.01)

(52) U.S. Cl. ..... 220/62.22; 222/562; 424/448; 206/441

(58) Field of Classification Search ..... 222/183, 222/108, 105, 131, 562, 399, 130, 206, 215, 222/420; 220/62.22; 424/448; 206/441
See application file for complete search history.

(56) References Cited

U.S. PATENT DOCUMENTS 2,623,660 A * 12/1952 Warren ..... 222/131
3,016,173 A * 1/1962 Stull ..... 222/541.2
3,381,818 A * 5/1968 Cope et al. ..... 206/524.2
3,760,987 A * 9/1973 Meterhoefer ..... 222/153.07
4,196,825 A * 4/1980 Kincaid ..... 222/107
4,634,023 A * 1/1987 Tanaka et al. ..... 222/105
4,875,603 A * 10/1989 Weinstein ..... 222/205
5,139,178 A * 8/1992 Arch et al. ..... 222/326
5,516,006 A * 5/1996 Meshberg ..... 222/25
5,678,731 A * 10/1997 Okamura et al. ..... 222/105
6,213,349 B1 * 4/2001 Yan ..... 222/83
6,439,438 B1 * 8/2002 Schouten et al. ..... 222/326
6,513,680 B2 * 2/2003 Nakayoshi et al. ..... 222/1
6,732,888 B1 * 5/2004 Smiley et al. ..... 222/485
7,128,241 B2 * 10/2006 Leung ..... 222/1
7,516,872 B2 * 4/2009 Boone et al. ..... 222/212

FOREIGN PATENT DOCUMENTS

JP 59-109743 U 7/1984

* cited by examiner

*Primary Examiner* — Kevin P Shaver
*Assistant Examiner* — Donnell Long
(74) *Attorney, Agent, or Firm* — Rader, Fishman & Grauer PLLC

(57) ABSTRACT

A container for adhesive agent, comprises a container main body having a storage section which stores the adhesive agent capable of dispersing as volatilized gas, and a cap which is attached to the storage section, and an outer covering which covers the container main body, wherein a projection is formed on the container main body so that a spaced section in which the volatized gas of the adhesive agent is kept is formed between an outer surface of the container main body and the outer covering.

14 Claims, 6 Drawing Sheets

CONTAINER FOR ADHESIVE AGENT, MANUFACTURE METHOD THEREOF

CROSS-REFERENCES TO RELATED APPLICATION

This application claims priority from Japanese Patent Application Serial No. 2006-162168 filed on Jun. 12, 2006, the contents of which are incorporated herein by reference in its entirety.

TECHNICAL FIELD

Described herein are a container for adhesive agent, and a manufacture method thereof, and an adhesive agent contained in a container, and more specifically a container for adhesive agent which comprises a container main body having a adhesive agent storage section and a cap attached to the storage section, and an outer covering material which covers the outer surface of the container main body, and a manufacture method of such a container for adhesive agent.

BACKGROUND

It is conventionally known that an instantaneous adhesive (alpha-cyanoacrylate adhesive, etc.) causes whitening (whitening) phenomenon while the adhesive is stored, thereby causing disfigurement of the container. The whitening phenomenon is a phenomenon in which a cyanoacrylate monomer is volatilized and hardened in the air thereby adhering to the surfaces of such as a container, as white powder. That is, the volatilized cyanoacrylate monomer gas flows out of the fitting portion etc. of the container to the outside of the container, and hardens on the surface of the container or an outer covering film, thereby causing the whitening phenomenon, so that the appearance of the container is disfigured, and the value thereof as a product is reduced. In order to prevent the whitening phenomenon, as disclosed in, for example, Japanese Laid Open Utility Model Patent No. S59-109743, a container for adhesive agent which is like the above container is known. In the container of an instantaneous adhesive disclosed in the Japanese Laid Open Utility Model Patent, the whitening phenomenon is prevented by carrying out heating contraction of a heat contraction nature film, thereby fixing it to a container.

However, since the container and the heat contraction nature film are brought into close contact with each other, the volatilized gas is transmitted through the film, so as to flow out to the outside thereof, so that the whitening phenomenon occurs on the film surface or the outer covering. Thus, the whitening phenomenon cannot be sufficiently prevented.

SUMMARY

In view of this conventional actual condition, the present container for adhesive agent, and the present manufacture method thereof, and the present adhesive agent contained in a container, are capable of more certainly preventing contamination of volatilized gas, and of maintaining the aesthetic design of the container over a long period of time, with the simple structure.

The present container for adhesive agent, comprises a container main body having a storage section which stores the adhesive agent capable of dispersing as volatilized gas, and a cap which is attached to the storage section, and an outer covering which covers the container main body, wherein a projection is formed on the container main body so that a spaced section in which the volatized gas of the adhesive agent is kept is formed between an outer surface of the container main body and the outer covering.

According to these features, even if volatilized gas flows out to the outside of a container main body, the volatilized gas can be kept in the spaced section, so that the volatilized gas hardens in the spaced section, and the outflow of the volatilized gas to the outside of the outer covering material can be prevented. Consequently, the deterioration of the aesthetic design of the container due to the whitening phenomenon resulting from volatilized gas etc. can be prevented certainly.

Moreover, the storage section further may be a nozzle section from which the adhesive agent is applied, and it may be desirable to provide the projection(s) at least in a coupling area formed by the storage section and the nozzle section. Moreover, the projection(s) may be provided at least in the coupling area of the storage section and the cap.

In the above container for adhesive agent, the above-mentioned projection(s) may be integrally formed on the main body of the container, or the projection(s) may be formed as a separate piece on the main body of the container.

Moreover, the projection(s) may be a ridgeline portion(s) which forms part of the main body of the container, and the projection(s) may also be one of the storage section, the cap and the nozzle section, which has the greatest outer diameter among them.

The adhesive agent which may disperse in form of volatilized gas is contained in the above-described container for adhesive agent. For example, an alpha-cyanoacrylate adhesive is contained therein.

Also, in order to achieve the above object, in the present invention, a method of manufacturing a container for adhesive agent, comprises a step of forming a projection on a container main body, and a step of attaching an outer covering to the container main body, so as to cover at least part of the container, so that a space is formed between an outer covering and an outer surface of the container by the projection, in a coupling portion of the container main body.

According to features of the present container for adhesive agent having a simple structure, the present manufacture method of a container for adhesive agent comprising simple steps, and the present adhesive agent contained in such a container, contamination due to volatilized gas can be more certainly prevented and it is possible to maintain the aesthetic design of the container over a long period of time.

The other purposes, components, and effects of the present invention will become clear from embodiments described below.

BRIEF DESCRIPTION OF DRAWINGS

Other features and advantages of the present container for adhesive agent, and manufacture method thereof will be apparent from the ensuing description, taken in conjunction with the accompanying drawings, in which.

DETAILED DESCRIPTION

Figure 1A:
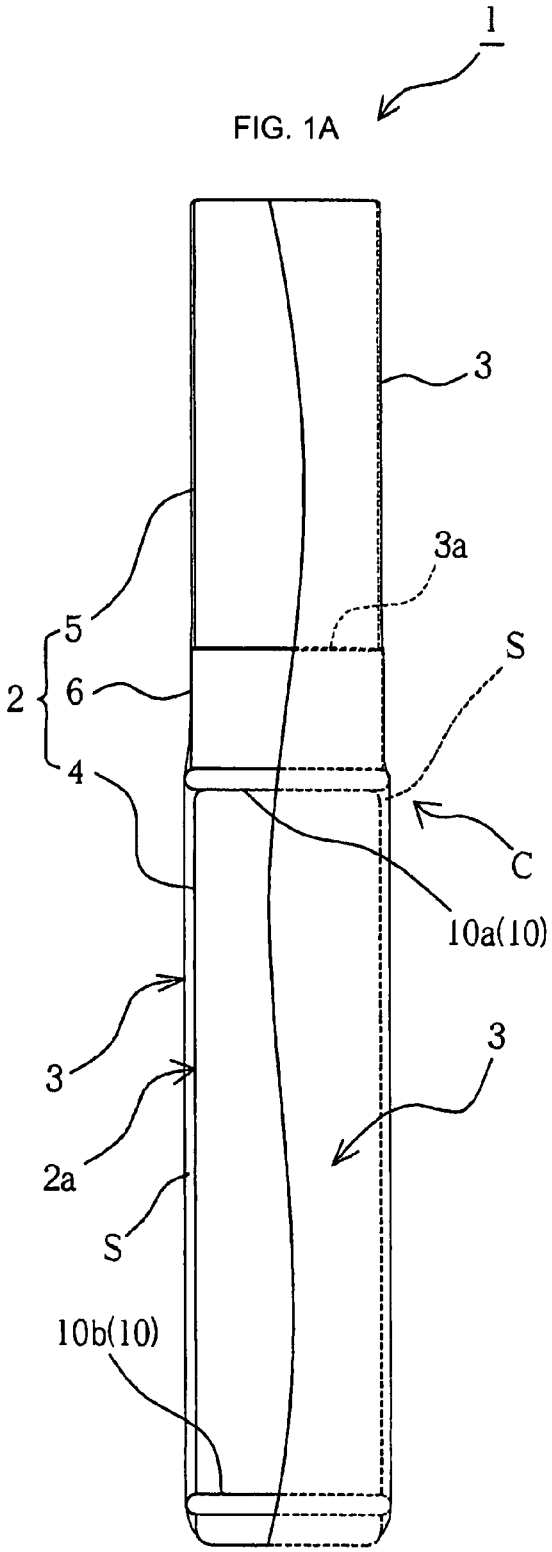
FIG. 1A is a schematic diagram of a container for adhesive agent according to an embodiment of a container for adhesive agent.

A first embodiment of a container for an adhesive agent G, in which the adhesive agent is an alpha-cyanoacrylate adhesive capable of dispersing as volatilized gas, is explained referring to FIGS. 1 and 2. A container 1 for adhesive agent according to the embodiment comprises mainly a container main body 2, and an outer covering material 3 which may be a package or film etc, in which the container main body 2 has a storage section 4 which stores the adhesive agent G, a nozzle section 6 and a cap 5 which is attached to the container main body 2 through a screw portion 6*a* of the nozzle section 6. In this embodiment, the outer covering material 3 is a heat contraction nature film, which covers the entire outer surface 2*a* of the container main body 2, in which heating contraction is carried out so that the film is attached to the container main body 2. Moreover, a perforation 3*a* is formed in the film 3 at the boundary section of the cap 5 and the nozzle section 6, and the film 3 can be opened from this perforation 3*a* at time of use. Although not shown, coloring, printing, etc. is given to the external surface of the film 3, and the esthetic design of the container for adhesive agent 1 is given to the outer surface of the film 3 with this coloring, printing, etc.

Figure 1B:
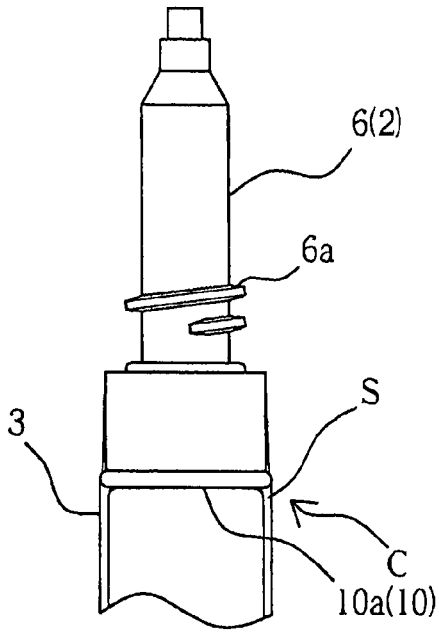
FIG. 1B shows a partially enlarged view thereof wherein a cap is removed.

In addition, a right-hand side of FIG. 1A shows a partial front view of a right portion of a container 1 for adhesive agent, and a left-hand side thereof shows a partial front view of a left portion of the container 1 for adhesive agent wherein the film 3 is transparent, for illustrative purposes. Moreover, FIGS. 1B, 1C, 3, 5A-5D and 6B show a container 1 respectively in the state where the film 3 is transparent, for illustrative purposes.

Figure 2A:
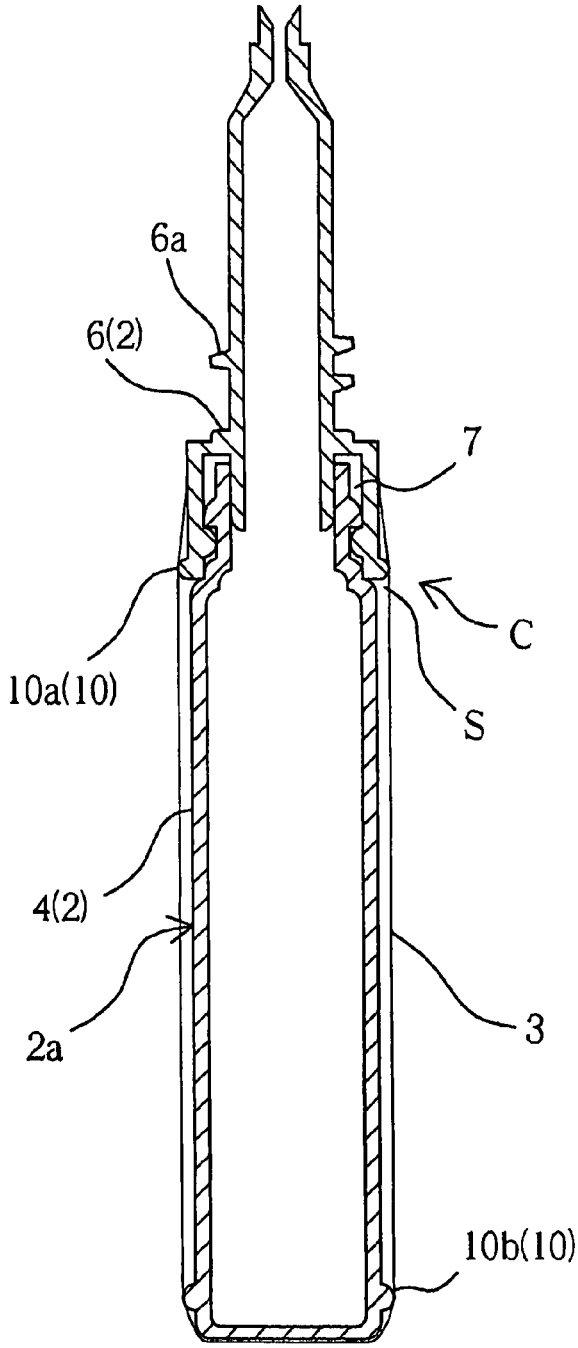
FIG. 2A is an enlarged vertical cross sectional view of FIG. 1B.
Figure 2B:
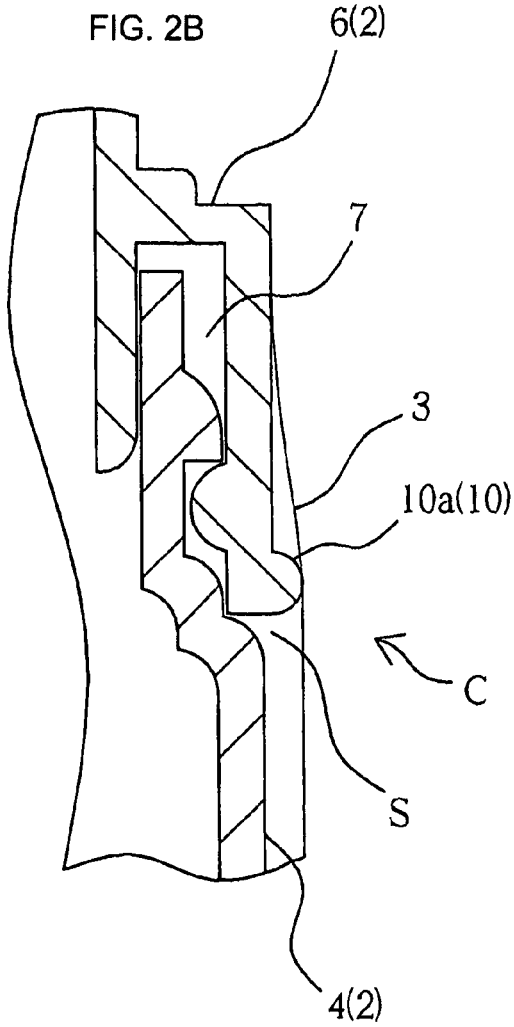
FIG. 2B is an enlarged vertical cross sectional view of an area near a coupling portion.

The nozzle section 6 for applying the stored adhesive agent G is attached to an upper part of the storage section 4. As shown in FIGS. 2A and 2B, the storage section 4 and the nozzle section 6 are separately formed, and are connected to each other by fitting up. As shown in FIG. 2B, a small gap 7 may be formed in a coupling area C of the storage section 4 and the nozzle section 6 because the storage section 4 and the nozzle section 6 may not be brought into close contact with each other. In that case, when the adhesive agent G stored in the storage section 4 is volatilized in the storage section 4, the volatilized gas mainly flows out to the outside the container main body 2 through the gap 7 formed when fitting up the storage section 4 and the nozzle section 6. In addition, since the tip of the nozzle section 6 is sealed before opening of the film 3, the volatilized gas does not flow out of the perforation 3*a* of the film 3 through the gap between the nozzle section 6 and the cap 5.

Moreover, as shown in FIG. 2A, in the container main body 2, a pair of annular projections 10*a* and 10*b* are formed in a lower end portion of the nozzle section 6 which forms the coupling area C and a portion near the bottom of the storage section 4. This projection 10*b* is integrally cast with the storage section 4, and the projection 10*a* is integrally cast with the nozzle section 6. A pair of these projections 10*a* and 10*b* is projected from the outer surface 2*a* of the container main body 2.

Figure 1C:
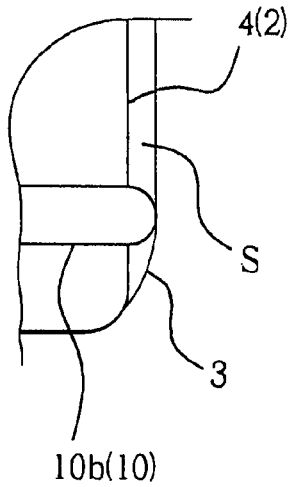
FIG. 1C is a partially enlarged view of an area near a projection.

As shown in FIG. 1C, when heating contraction of the film 3 is carried out, the film 3 is attached to the container main body 2, leaving a spaced section S formed between the container main body 2 and the film 3 by the projection 10*b*.

Moreover, as shown in FIG. 2B, the spaced section S can be formed by the projection 10*a* formed in a lower end portion of the nozzle section 6 in the coupling area C, so as to cover the coupling area C. Thereby, when the volatilized gas of the adhesive agent G which flows out to the outside of the container main body 2 through the gap 7 is kept in the spaced section S, and the volatilized gas hardens therein, so that the outflow of the volatilized gas to the outside of the film 3 can be prevented, and contamination on the outer surface of the film 3 due to the whitening phenomenon resulting from the volatilized gas can be prevented. Therefore, the esthetic design of the container 1 for adhesive agent can be maintained over a long period of time. In other words, the container can be maintained as designed, without any dirt due to the whitening phenomenon.

Next, a second embodiment of a container for adhesive agent is explained. In addition, the same numerals are given to the same elements as those in the first embodiment. In this embodiment, an alpha-cyanoacrylate adhesive is used as an adhesive agent G which may disperse as volatilized gas.

Figure 3:
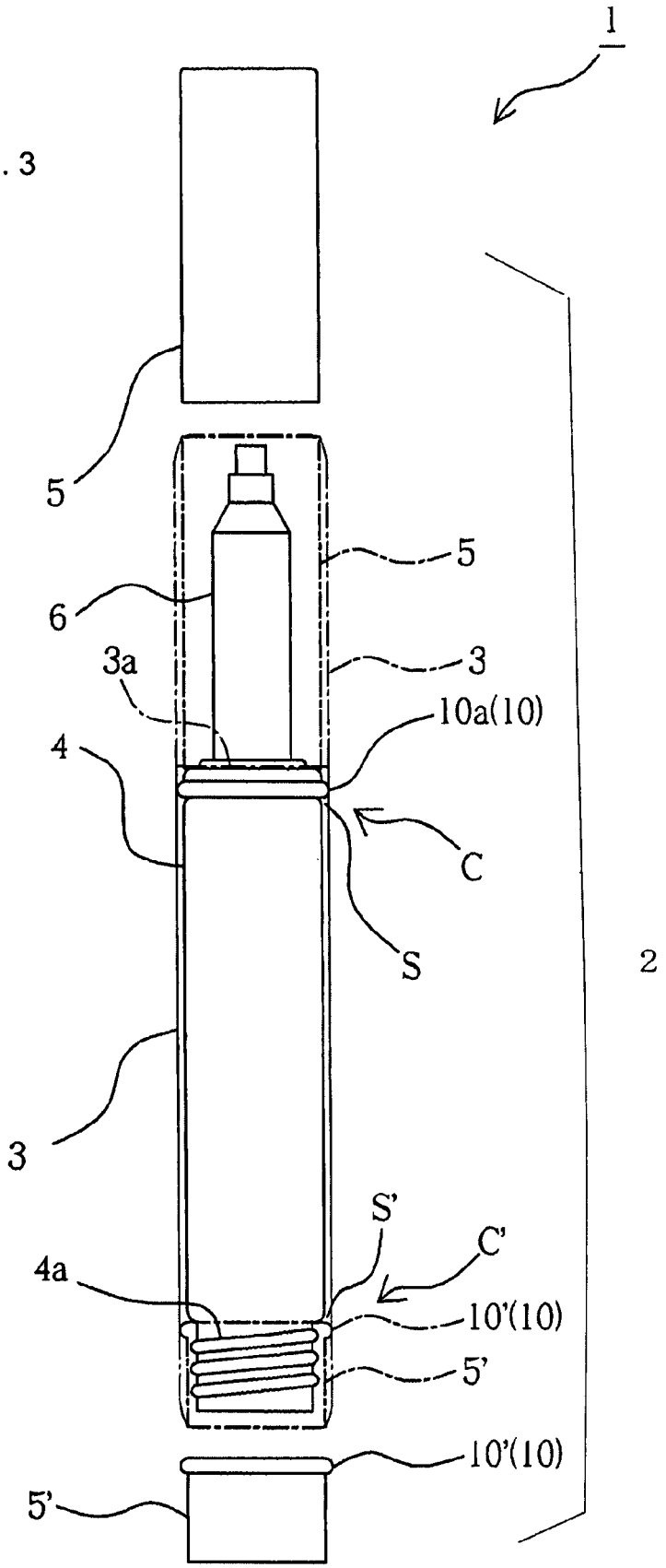
FIG. 3 shows another embodiment of a container for adhesive agent.

As shown in FIG. 3, in this embodiment, a container main body 2 comprises a storage section 4 and a cap 5, and a tail cap 5' attached to a lower end portion of the storage section 4. After the storage section 4 is filled up with the adhesive agent G, the tail cap 5' is attached to the storage section 4 by screwing together with a screw portion 4*a* provided at the bottom of the storage section 4. Moreover, an annular projection 10' is provided on an end side portion of the tail cap 5' in a side of the storage section 4.

Figure 4:
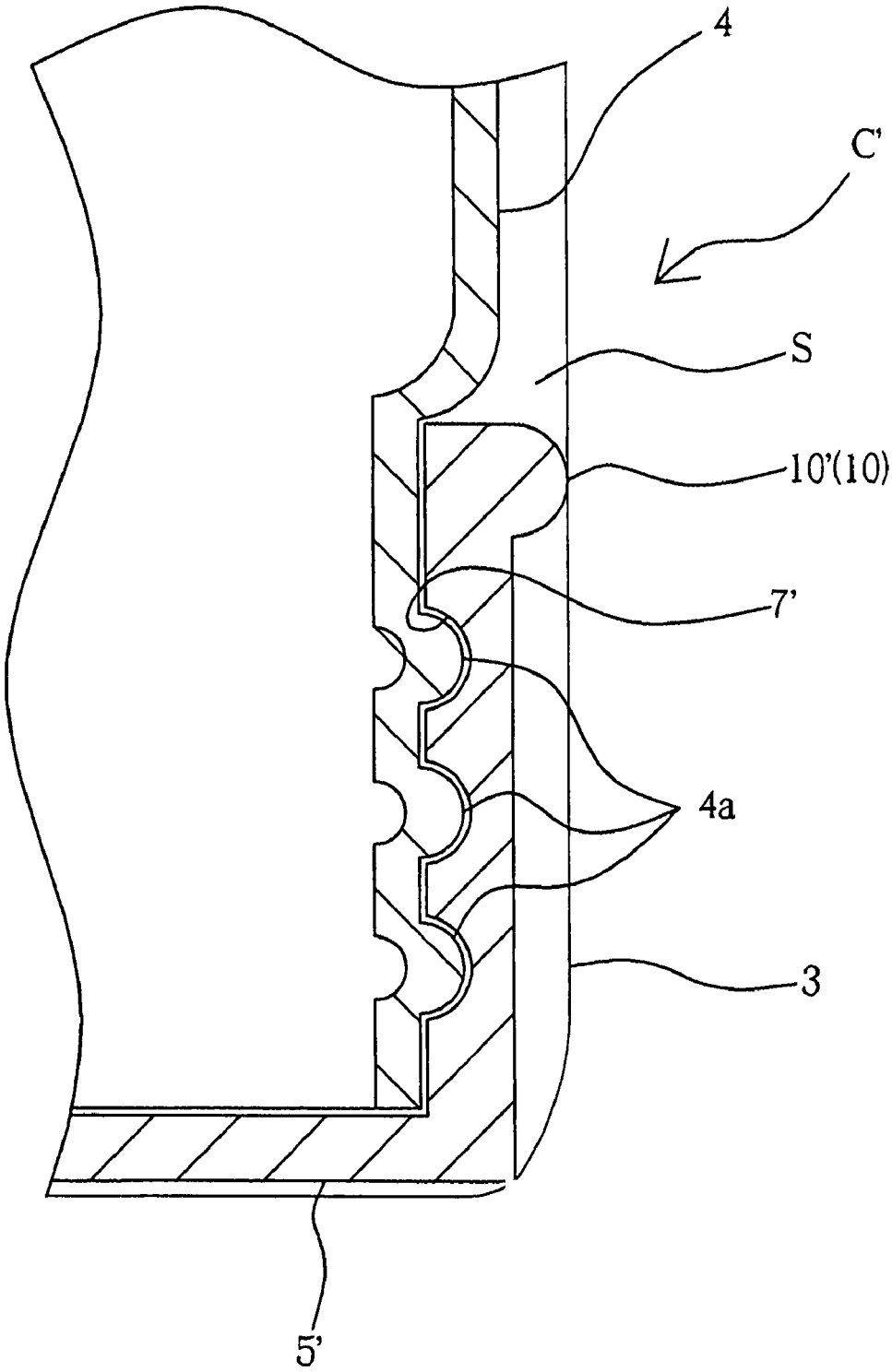
FIG. 4 shows an enlarged vertical cross sectional view of an area near a coupling portion wherein a tail cap is attached.

As shown in FIG. 4, in a coupling area C' formed by the screwing of the storage section 4 and the tail cap 5', a small gaps 7' may be formed between the storage section 4 and the tail cap 5'. In that case, when the adhesive agent G in the storage section 4 is volatilized in the storage section 4, it flows out of the container main body 2 through the gap 7' formed by screwing of the storage section 4 and the tail cap 5'.

A spaced section S can be formed between the container main body 2 and the film 3 by this projection 10' so that the coupling area C' formed by the storage section 4 and the tail cap 5' into which the volatilized gas may flow is covered. Thereby, since the volatilized gas which flows out of the gap 7' of the coupling area C' is kept in the spaced section S and the volatilized gas hardens in the space section S, so that the outflow of the volatilized gas to the outside of the film 3 can be prevented, and contamination on the outer surface of the film 3 due to the whitening phenomenon resulting from the volatilized gas can be prevented.

In addition, as in the first embodiment, a projection 10*a* is formed at a bottom end portion of the nozzle section 6 at the coupling area C formed by the storage section 4 and the nozzle section 6, and the projection 10' is paired with the projection 10*a*.

Possibility of other embodiments will be described below. In each of the above-mentioned embodiments, the alpha-cyanoacrylate adhesive is used as an adhesive agent which may disperse as volatilized gas. What may be necessary is that the adhesive agent can be volatilized so as to disperse or has similar effects, but the adhesive agent is not limited thereto. The structure of the present invention can be also used to control pollution due to re-liquefaction of volatilized gas.

Moreover, coloring, printing, etc. are given to the film 3 in each of the above-mentioned embodiments. However, such coloring, printing, etc. may not be needed. However, it is more desirable to give such coloring, printing, etc. to the surface of the film 3 to the extent that the spaced section cannot be seen through the film 3, since the dirt resulting from the volatilized gas which has hardened in the spaced section causes disfigurement of the esthetic design if the spaced section can be seen through the film.

Figure 5A:
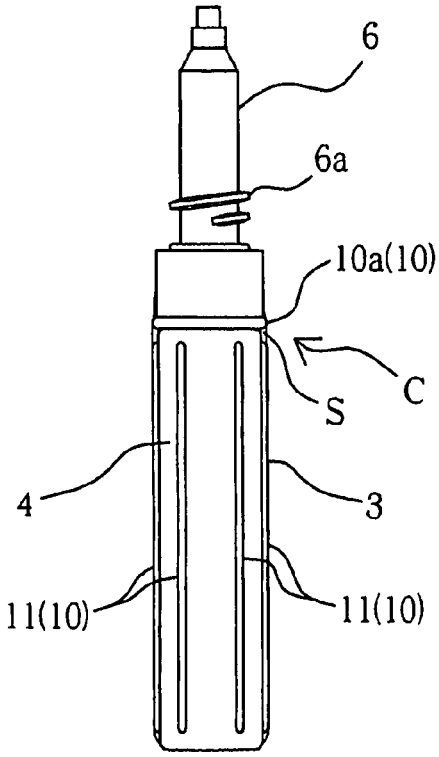
FIG. 5A is a schematic view of a container for adhesive agent wherein a rod shape members are formed as projections.
Figure 5B:
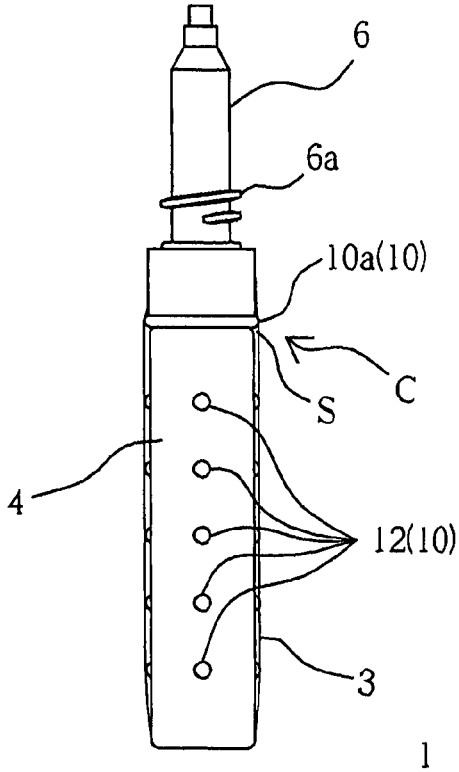
FIG. 5B is a schematic view of a container for adhesive agent wherein a semi-spherical members are formed as projections.
Figure 5C:
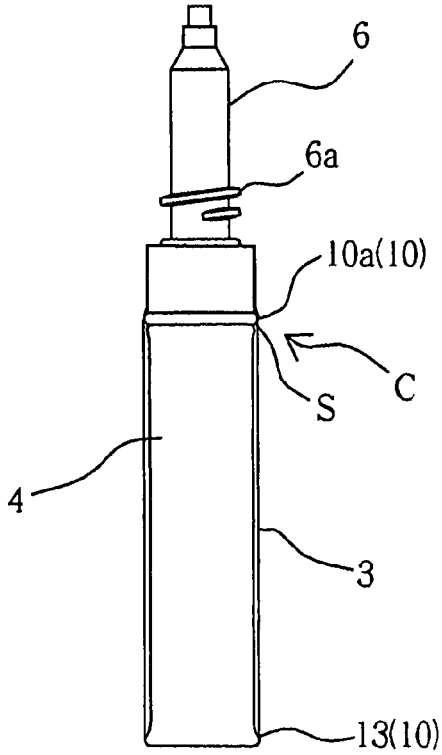
FIG. 5C is a schematic view of a container for adhesive agent wherein an angle section is formed as a projection.

In each of the embodiments, the shape of the projections 10*a* and 10*b* and 10' is annular. However, the shape of the projection 10 is not limited thereto, and as shown in FIG. 5A, for example, the projection 10 may comprise two or more rod shape members 11 provided at intervals which are suitably set along with the longitudinal direction of outer surface 2*a* of the storage section 4, or as shown in FIG. 5B, it may comprise two or more semi-sphere members 12. The number of the projection 10 or the member 12 may be one in a certain circumstances. Furthermore, unlike the above embodiments, as shown in FIG. 5C, an angle section 13 formed at the bottom of the storage section 4 may be formed so that it may become larger than the outer diameter of the storage section 4.

Figure 5D:
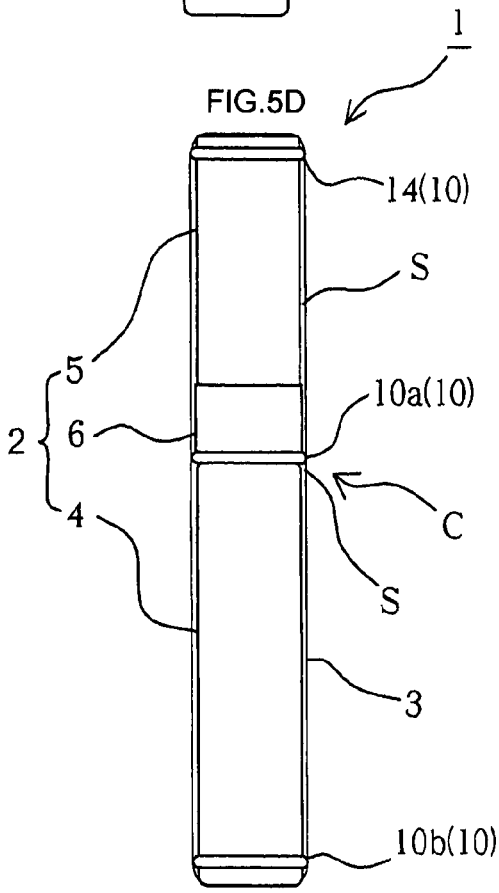
FIG. 5D is a schematic view of a container for adhesive agent wherein a projection is formed on a cap.

Furthermore, the number or position of a projection(s), is not limited to that of the embodiments, or for example, as shown in FIG. 5D, an annular projection 14 may be additionally provided in a top edge portion of the cap 5. Moreover, the projection(s) in the embodiments shown in FIG. 5A-5C, may be provided on a portion other than the storage section 4, and it may be provided all over the container main body 2.

Moreover, in the above embodiments, the projection 10 is integrally formed on the container main body. However, it may be formed not only integrally by molding with but also separately from the container main body. For example, a string(s), a band(s), etc. may be winded around the container main body, so as to form a projection(s).

Thus, in the above embodiments, a component(s) which serves as a projection 10 is provided integrally or as a separate member on the outer surface 2*a* of the container main section 2, and it corresponds to the projections 10*a* and 10*b*, 10', and 14, a rod shape member 11, the semi-sphere object 12 and the angle section 13.

Figure 6A:
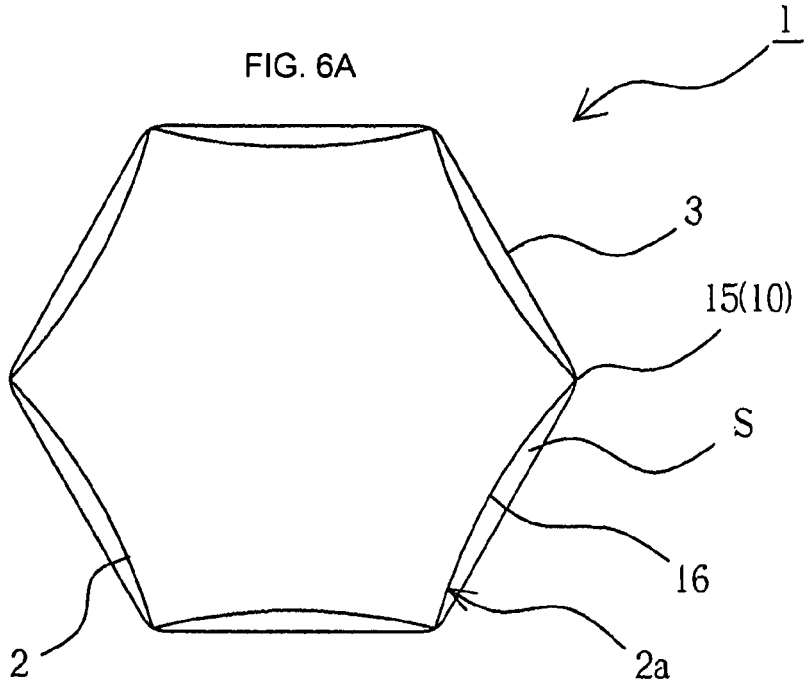
FIG. 6A is a schematic view of a container for adhesive agent according to another embodiment, wherein ridgeline portions are formed.

On the other hand, as shown in FIG. 6A, a film may be attached to the container main body having ridgeline portion(s). As shown in this figure, a container main body 2 is a hexagon in a plane view, the ridgeline portions 15 are formed therein, and an outer surface 2*a* formed between the adjoining ridgeline portions 15 and 15 curves with respect to the center of container main body 2, so as to form a concave portion 16.

Unlike the above-mentioned embodiments, these ridgeline portions 15 are not portions that are provided so as to project above the outer surface 2*a* but these portions relatively project with respect to the outer surface 2*a* because of the concave portion 16. However, the ridgeline portions 15 which project relatively with respect to the outer surface 2*a*, function as projections like the above-mentioned embodiments, which form the spaced portion S, so that they can form the spaced portion S between the container main body 2 and film 3.

Figure 6B:
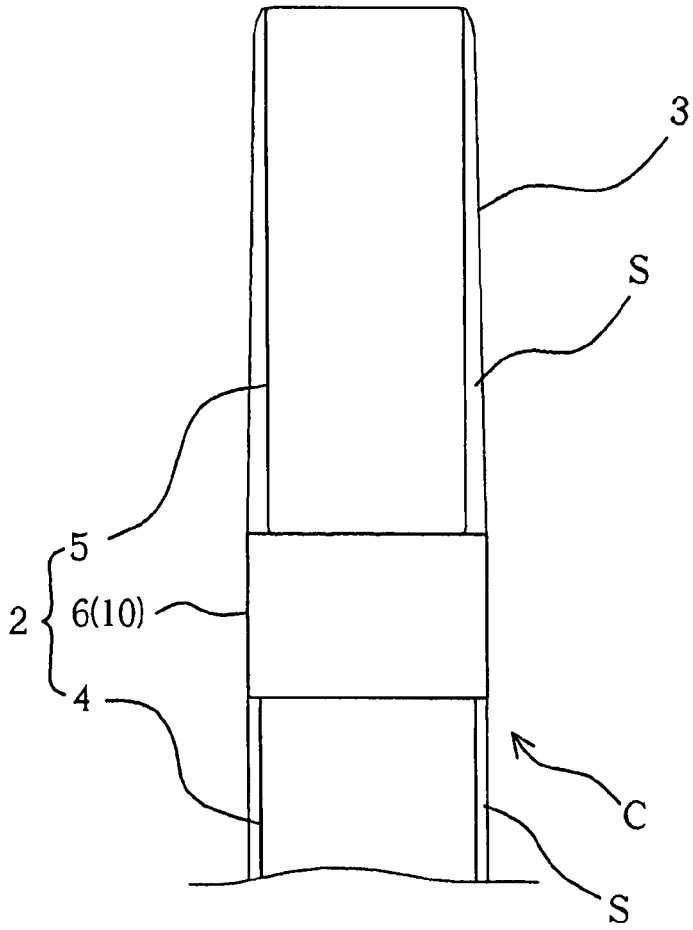
FIG. 6B is a schematic view of a container for adhesive agent according to still another embodiment, wherein a nozzle portion is provided as a projection.

Moreover, as shown in FIG. 6B, the outer diameter of one of the storage section 4 of the container main body 2, the cap 5, or the nozzle section 6 may be different from the others (or one another). In this figure, the component which has the maximum diameter is the nozzle section 6, and this nozzle section 6 relatively projects from the outer surface 2*a* of the container main body 2. That is, the nozzle section 6 itself, functions as a projection for forming the spaced portion S, and the spaced section S can be formed between the storage section 4 and the film 3, and the cap 5 and the film 3.

That is, the "projection" includes not only a member(s) which projects from the outer surface 2*a* of the container main body 2, such as the projections 10*a*, 10*b*, 10', and 14, the rod shape members 11, the semi-sphere members 12, and the angle section 13, but also a portion(s) which relatively projects in the outer surface 2*a* of the container main body 2, such as the ridgeline portion(s) 15 or portions having different diameters. However, the "projection" is not limited to the above examples.

Moreover, in the above-mentioned embodiments, the film 3 is attached to all over the outer surface of the container main body 2. However, it is not limited to the examples, and for example, the film may be attached to only the nozzle section and the storage section. However, since volatilized gas flows out to the outside of the container main body from the gap formed in the coupling area, the film needs to be attached so that the spaced section is formed so as to cover at least the coupling area.

In addition, unlike the above-mentioned embodiments, the spaced section can also be formed by forming a wrinkle(s) between the container main body and the film. However, since the wrinkle(s) is formed on the film in this embodiment, the other embodiments are more excellent than this embodiment in view of the esthetic design of the container.

The above-mentioned embodiments may be practiced respectively independently, or in combination.

The present invention can be applied to but not limited to a container for adhesive agent, especially a container for adhesive agent which may disperse as volatilized gas, for example, an alpha-cyanoacrylate adhesive.

The preceding description has been presented only to illustrate and describe exemplary embodiments of the container for adhesive agent, and manufacture method thereof according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A container for an adhesive agent, comprising:

a container main body which stores the adhesive agent capable of dispersing as a volatilized gas and includes a storage section and a nozzle section releasably connected to each other and forming a gap between the storage section and the nozzle section when releasably connected to each other, the storage section defining an adhesive-containing cavity, the container main body having an outer surface, a film, and a projection formed on the container main body adjacent the gap and projecting away from the outer surface of the container main body such that the film covers the container main body in a manner that the film contacts the projection while the projection retains the film away from the outer surface in a spaced-apart manner to form a space between the film and the outer surface with the gap being disposed between and in fluid communication with the adhesive-containing cavity and the space, wherein, when the volatilized gas flows out of the adhesive-containing cavity through the gap, the volatilized gas is retained in the space.

2. A container for an adhesive agent, comprising:

a container main body which stores the adhesive agent capable of dispersing as a volatilized gas and includes a storage section and a nozzle section connected to each other, the storage section defining an adhesive-containing cavity, the container main body having an outer surface;

a film;

a tail cap releasably connected to the storage section and forming a gap between the storage section and the tail cap when releasably connected to each other; and a projection formed on the container main body adjacent the gap and projecting away from the outer surface of the container main body such that the film covers the container main body in a manner that the film contacts the projection while the projection retains the film away from the outer surface in a spaced-apart manner to form a space between the film and the outer surface with the gap being disposed between and in fluid communication with the adhesive-containing cavity and the space, wherein, when the volatilized gas flows out of the adhesive-containing cavity through the gap, the volatilized gas is retained in the space.

3. The container for adhesive agent according to claim 1 or 2, wherein the projection is formed in a coupling area formed by the storage section and the nozzle section.

4. The container for adhesive agent according to claim 1 or 2, wherein the projection is formed in a coupling area formed by the storage section and the tail cap.

5. The container for adhesive agent according to claim 1 or 2, wherein the projection is integrally formed with the container main body.

6. The container for adhesive agent according to claim 1 or 2, wherein the projection is formed on the container main body as a separate piece from the container main body.

7. The container for adhesive agent according to claim 1 or 2, wherein the projection comprises a ridgeline of the container main body.

8. The container for adhesive agent according to claim 1 or 2, the projection is larger than the storage section, the cap and the nozzle section in diameter.

9. The container for adhesive agent according to claim 1 or 2, wherein the adhesive agent is alpha-cyanoacrylate adhesive.

10. The container for adhesive agent according to claim 1 or 2, wherein the adhesive agent capable of dispersing as volatilized gas is stored in the storage section.

11. An adhesive agent capable of dispersing as volatilized gas wherein the adhesive agent is stored in the storage section according to claim 1 or 2.

12. A method of manufacturing a container according to claim 1, comprising the following steps of:

coupling the storage section and the nozzle section by screwing or fitting at a coupling area;

forming the projection on the outer surface of the container main body;

attaching the film about the container main body to cover the coupling area; and forming the space between the film and the outer surface of the container based on the projection so as to keep the volatized gas of the adhesive agent within the space.

13. A method of manufacturing a container according to claim 2, comprising the following steps of:

coupling the storage section and the tail cap by screwing or fitting at a coupling area;

forming the projection on the outer surface of the container main body;

attaching the film about the container main body to cover the coupling area; and forming the space between the film and the outer surface of the container based on the projection so as to keep the volatized gas of the adhesive agent within the space.

14. The container for adhesive agent according to claim 1 or 2, wherein the film is a heat contraction film.

* * * * *